US012134954B2

(12) United States Patent
Lamb et al.

(10) Patent No.: US 12,134,954 B2
(45) Date of Patent: Nov. 5, 2024

(54) INTERVENTIONLESS INJECTION SAFETY VALVE

(71) Applicant: Schlumberger Technology Corporation, Sugar Land, TX (US)

(72) Inventors: Justin David Elroy Lamb, Arcola, TX (US); Garis Mccutcheon, Missouri City, TX (US); Francesco Vaghi, Houston, TX (US); Hy Phan, Houston, TX (US); Marco Quilico, Pearland, TX (US); Jason Henry, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 76 days.

(21) Appl. No.: 18/002,061

(22) PCT Filed: Jun. 25, 2021

(86) PCT No.: PCT/US2021/039071
§ 371 (c)(1),
(2) Date: Dec. 16, 2022

(87) PCT Pub. No.: WO2021/263092
PCT Pub. Date: Dec. 30, 2021

(65) Prior Publication Data

US 2023/0220745 A1 Jul. 13, 2023

Related U.S. Application Data

(60) Provisional application No. 63/044,750, filed on Jun. 26, 2020.

(51) Int. Cl.

| | |
|---|---|
| ***E21B 34/06*** | (2006.01) |
| ***E21B 34/12*** | (2006.01) |
| ***E21B 34/14*** | (2006.01) |

(52) U.S. Cl.
CPC ..... *E21B 34/125* (2013.01); *E21B 34/063* (2013.01); *E21B 34/14* (2013.01); *E21B 2200/08* (2020.05)

(58) Field of Classification Search
CPC ..... E21B 33/0375; E21B 34/14
See application file for complete search history.

(56) References Cited

U.S. PATENT DOCUMENTS 3,865,141 A 2/1975 Young
3,981,358 A 9/1976 Watkins et al.
(Continued)

FOREIGN PATENT DOCUMENTS

CN 103953313 A 7/2014
CN 204041004 U 12/2014
(Continued)

OTHER PUBLICATIONS

International Search Report and Written Opinion issued in the PCT Application PCT/US2021/039071, dated Oct. 5, 2021 (11 pages).

*Primary Examiner* — Tara Schimpf
*Assistant Examiner* — Yanick A Akaragwe
(74) *Attorney, Agent, or Firm* — Jeffrey D. Frantz

(57) ABSTRACT

A safety valve includes a housing having a bore, a flow tube, and a valve closure member. The flow tube resides in the bore, is configured to move telescopically within the bore, and is adapted to shift the valve closure member between a closed position and an open position. The safety valve also includes an annular section between an inner surface of the housing and an outer surface of the flow tube, and means for preventing fluid flowing through the bore from entering the annular section.

16 Claims, 4 Drawing Sheets

(56) References Cited

U.S. PATENT DOCUMENTS

| | | | | |
|---|---|---|---|---|
| 4,161,219 | A | 7/1979 | Pringle | |
| 5,411,096 | A * | 5/1995 | Akkerman | E21B 34/10 251/63.4 |
| 8,002,040 | B2 | 8/2011 | May | |
| 2011/0147015 | A1* | 6/2011 | Mickey | E21B 33/128 166/387 |
| 2016/0138365 | A1 | 5/2016 | Vick, Jr. | |
| 2017/0167226 | A1 | 6/2017 | Barbato | |
| 2019/0040695 | A1 | 2/2019 | Sim | |
| 2021/0017833 | A1* | 1/2021 | Saraya | E21B 33/1208 |

FOREIGN PATENT DOCUMENTS

| | | | |
|---|---|---|---|
| GB | 2564818 | A | 1/2019 |
| WO | 2018208493 | A1 | 11/2018 |
| WO | 2021252744 | A1 | 12/2021 |

* cited by examiner

INTERVENTIONLESS INJECTION SAFETY VALVE

CROSS-REFERENCE TO RELATED APPLICATION

The present document is the National Stage Entry of International Application No. PCT/US2021/039071, filed Jun. 25, 2021, which is based on and claims priority to U.S. Provisional Application Ser. No. 63/044,750, filed Jun. 26, 2020, which is incorporated herein by reference in its entirety.

BACKGROUND

Subsurface safety valves are commonly used in wells to prevent uncontrolled fluid flow through the well in the event of an emergency, such as to prevent a well blowout. Conventional safety valves use a flapper, which is biased by a spring to a normally closed position, but is retained in an open position by the application of hydraulic fluid from the earth's surface. Conventionally, proppant stimulation treatments or other harsh injection applications may have a corrosive effect on the material from which subsurface safety valves have been made. Accordingly, there is a need to protect subsurface safety valves during such stimulation treatments and injection applications without well intervention.

SUMMARY

According to one or more embodiments of the present disclosure, a safety valve includes a housing having a bore; a flow tube residing in the bore and configured to move telescopically within the bore; an annular section between an inner surface of the housing and an outer surface of the flow tube; a valve closure member, wherein the flow tube is adapted to shift the valve closure member between a closed position and an open position; and means for preventing fluid flowing through the bore from entering the annular section.

According to one or more embodiments of the present disclosure, a device includes, a housing having a bore, the bore having an internal profile; and a temporary barrier that adheres to and protects the internal profile by creating a seamless and continuous diameter within the bore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," "left" and "right," and other like terms indicating relative positions above or below a given point or element are used in this description to more clearly describe some embodiments of the disclosure.

The present disclosure generally relates to subsurface safety valves. More specifically, one or more embodiments of the present disclosure relate to subsurface safety valves that are designed to withstand proppant stimulation treatments or other harsh injection applications, and methods of making the same.

One or more embodiments of the present disclosure eliminates the need to have a well intervention to install a protection barrier inside a safety valve before performing a proppant stimulation treatment or other harsh injection application. Indeed, in an apparatus and method according to one or more embodiments of the present disclosure, rugged and robust designs that can withstand the erosion and debris generated from a proppant stimulation treatment or other harsh injection application are realized.

Figure 1:
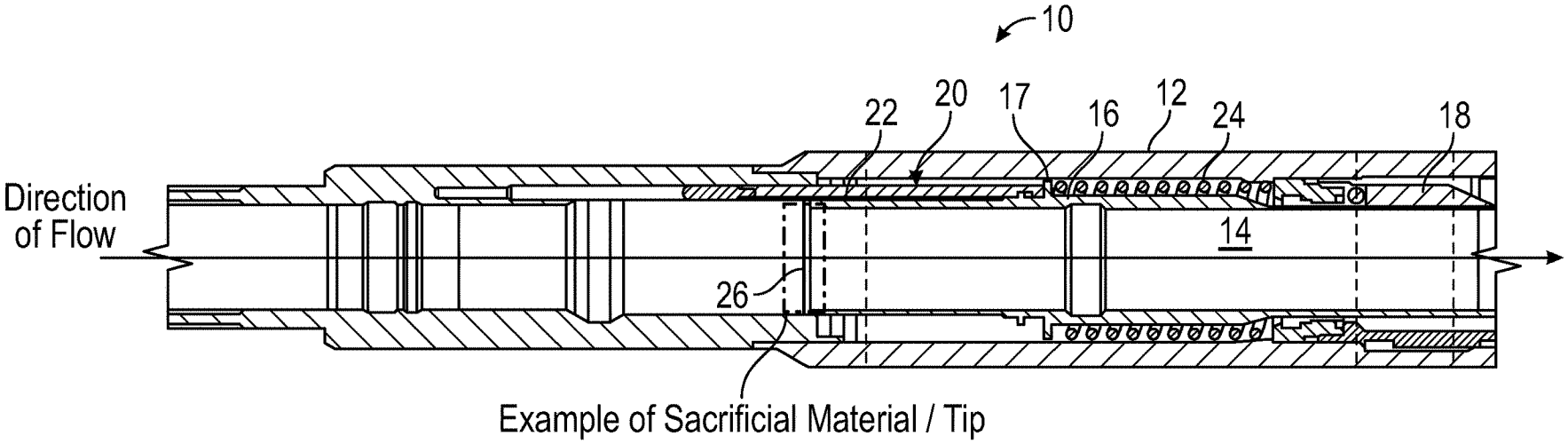
FIG. 1 shows a safety valve including a sacrificial material according to one or more embodiments of the present disclosure.

Referring now to FIG. 1, a safety valve including a sacrificial material according to one or more embodiments of the present disclosure is shown. As shown in FIG. 1, the safety valve 10 may include a housing 12 having a bore 14, and a flow tube 16 residing in the bore 14. In one or more embodiments of the present disclosure, the flow tube 16 is configured to move telescopically within the bore 14 of the housing 12. As the flow tube 16 moves telescopically within the bore 14 of the housing 12, the flow tube 16 is adapted to shift a valve closure member 18 of the safety valve 10 between a closed position and an open position, for example. In one or more embodiments of the present disclosure, the valve closure member 18 may be a flapper, as shown in FIG. 1 for example. However, the valve closure member 18 may include a ball valve, a circulation valve, or another type of barrier valve without departing from the scope of the present disclosure.

As previously described, the flow tube 16 may move telescopically within the bore 14 of the housing 12 to shift the valve closure member 18 of the safety valve 10 between closed and open positions. In one or more embodiments of the present disclosure, a valve actuator 22 may facilitate the telescopic movement of the flow tube 16. In one or more embodiments of the present disclosure, the valve actuator 22 may be triggered, inter alia, mechanically, hydraulically, electrically, magnetically, via pressure, thermally, optically, wirelessly, or chemically to actuate the flow tube 16. As shown in FIG. 1, for example, the valve actuator 22 may be a hydraulic piston coupled to a hydraulic control line. As further shown in FIG. 1, for example, the valve actuator 22 may be operatively connected to the flow tube 16 and a spring 24. For example, the valve actuator 22 may be positioned to act against a shoulder 17 of the flow tube 16 in one or more embodiments of the present disclosure. Operationally, when the appropriate trigger (e.g., hydraulic input, control pressure, etc.) is provided to the valve actuator 22 such that the valve actuator 22 is shifted in the downward direction, the valve actuator 22 actuates the flow tube 16 in the downward direction within the bore 14, compressing the spring 24. The continued downward movement of the flow tube 16 forces the flow tube 16 through the valve closure member 18, which forces the valve closure member 18 into the open position shown in FIG. 1. According to one or more embodiments of the present disclosure, proppant stimulation treatments and other injection applications may proceed while the valve closure member 18 is in the open position. Alternatively, when the valve actuator 22 is forced in an upward direction, the valve actuator 22 actuates the flow tube 16 in the upward direction, enabling the valve closure member 18 to transition to the closed position.

As further shown in FIG. 1, the safety valve 10 may include an annular section 20 provided in the space between an inner surface of the housing 12 and an outer surface of the flow tube 16, according to one or more embodiments of the present disclosure. In one or more embodiments of the present disclosure, at least a portion of the valve actuator 22, the spring 24, and the valve closure member 18 when the valve closure member 18 is in the open position may be disposed in the annular section 20 of the safety valve 10, as shown in FIG. 1, for example.

In one or more embodiments of the present disclosure, the safety valve 10 includes means for preventing fluid flowing through the bore 14 from entering the annular section 20 of the valve. For example, as shown in FIG. 1, the means for preventing fluid flowing through the bore 14 from entering the annular section 20 may be a sacrificial material 26 disposed in the bore 14. Specifically, in one or more embodiments of the present disclosure, the sacrificial material 26 may be disposed on a tip of the flow tube 16. By preventing fluid flowing through the bore 14 from entering the annular section 20 of the safety valve 10, the internal components of the safety valve 10 (i.e., the spring 24, the valve closure member 18, the valve actuator 22, etc.) may be protected from erosion and debris generated from proppant stimulation treatments or other injection operations. Moreover, the sacrificial material 26 provides for an interventionless design insofar as a separate intervention is not required to install the sacrificial material 26 once the safety valve 10 is installed downhole. Indeed, the safety valve 10 may be assembled with the sacrificial material 26 already installed before the safety valve 10 is run downhole. The elimination of an additional trip to install the sacrificial material 26 advantageously saves time and money over solutions that require an intervention, for example. In one or more embodiments of the present disclosure, the sacrificial material 26 comprises a metallic material, such as an aluminum alloy, or any other material that is capable of dissolving or degrading over time, for example.

Figure 2:
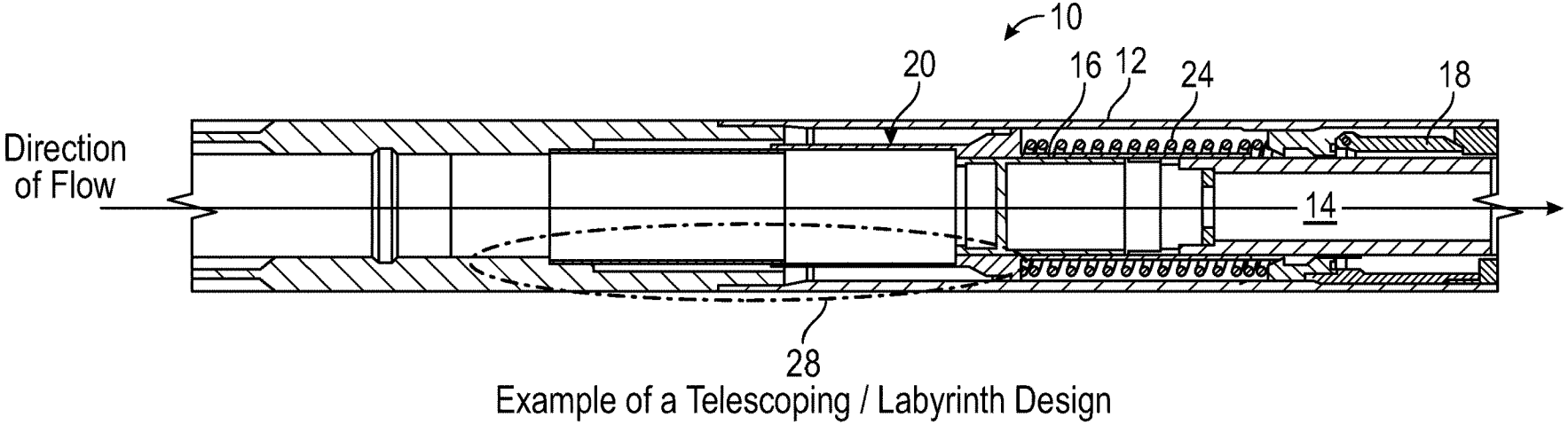
FIG. 2 shows a safety valve including a telescoping/labyrinth design according to one or more embodiments of the present disclosure.

Referring now to FIG. 2, in one or more embodiments of the present disclosure, the means for preventing fluid flowing through the bore 14 from entering the annular section 20 may include a telescoping assembly 28 attached to the flow tube 16 that blocks the annular section 20. As shown in FIG. 2, for example, the telescoping assembly 28 is affixed to the top of safety valve 10, is attached to the flow tube 16, and adopts a configuration that cooperates with an internal profile of the bore 14 as it blocks the annular section 20 of the safety valve 10. Due to the configuration of the telescoping assembly 28, fluid flowing through the bore 14 during proppant stimulation treatments or other injection operations is prevented from entering the annular section 20 of the safety valve 10. Allowing debris to flow into critical areas such as the annular section 20 of the safety valve 10 may prevent the safety valve 10 from working properly. As such, the internal components of the safety valve 10 (i.e., the spring 24, the valve closure member 18, the valve actuator 22, etc.) may be protected from erosion and debris generated from such treatments and operations with the implementation of means for preventing fluid flowing through the bore 14 from entering the annular section 20 of the safety valve 10, such as the telescoping assembly 28 shown in FIG. 2.

Moreover, the telescoping assembly 28 according to one or more embodiments of the present disclosure provides for an interventionless design insofar as a separate intervention is not required to install the telescoping assembly 28 once the safety valve 10 is installed downhole. Indeed, the safety valve 10 may be assembled with the telescoping assembly 28 already installed before the safety valve 10 is run downhole. The elimination of an additional trip to install the telescoping assembly 28 advantageously saves time and money over solutions that require an intervention, for example. In one or more embodiments of the present disclosure, the telescoping assembly 28 is made out of an erosion resistant material that is able to prevent leakage into the annular section 20 during the operational life of the safety valve 10.

Figure 3A:
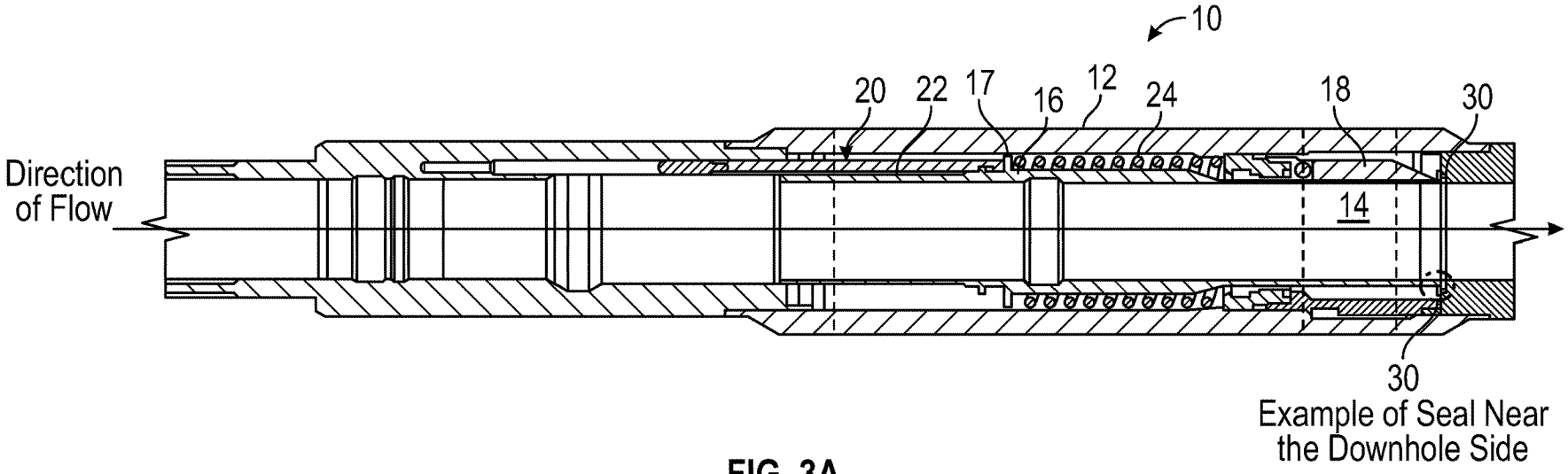
FIGS. 3A-3C show a safety valve including at least one seal according to one or more embodiments of the present disclosure.
Figure 3B:
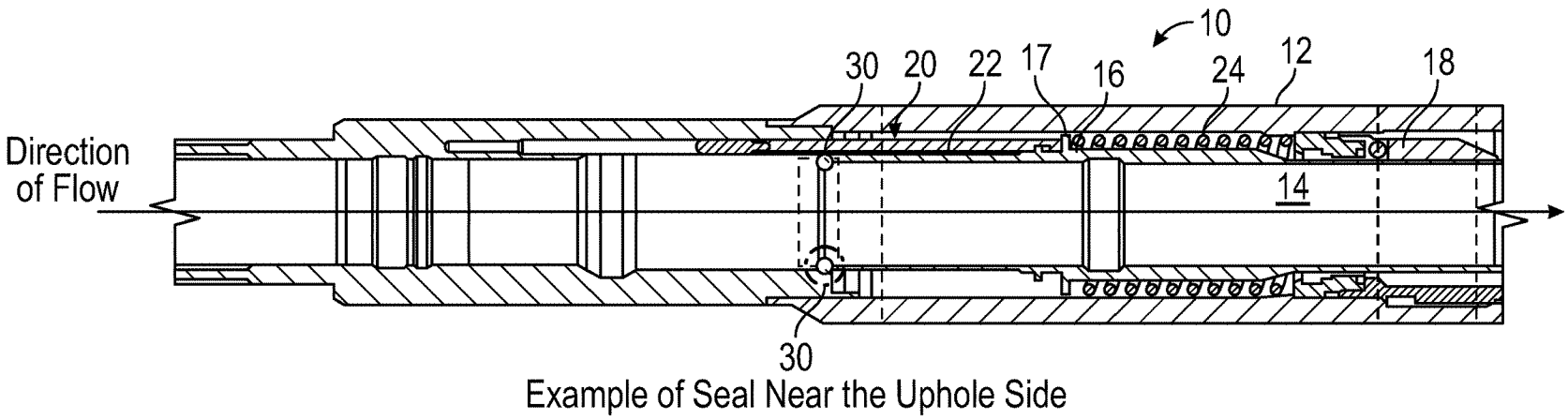
Figure 3C:
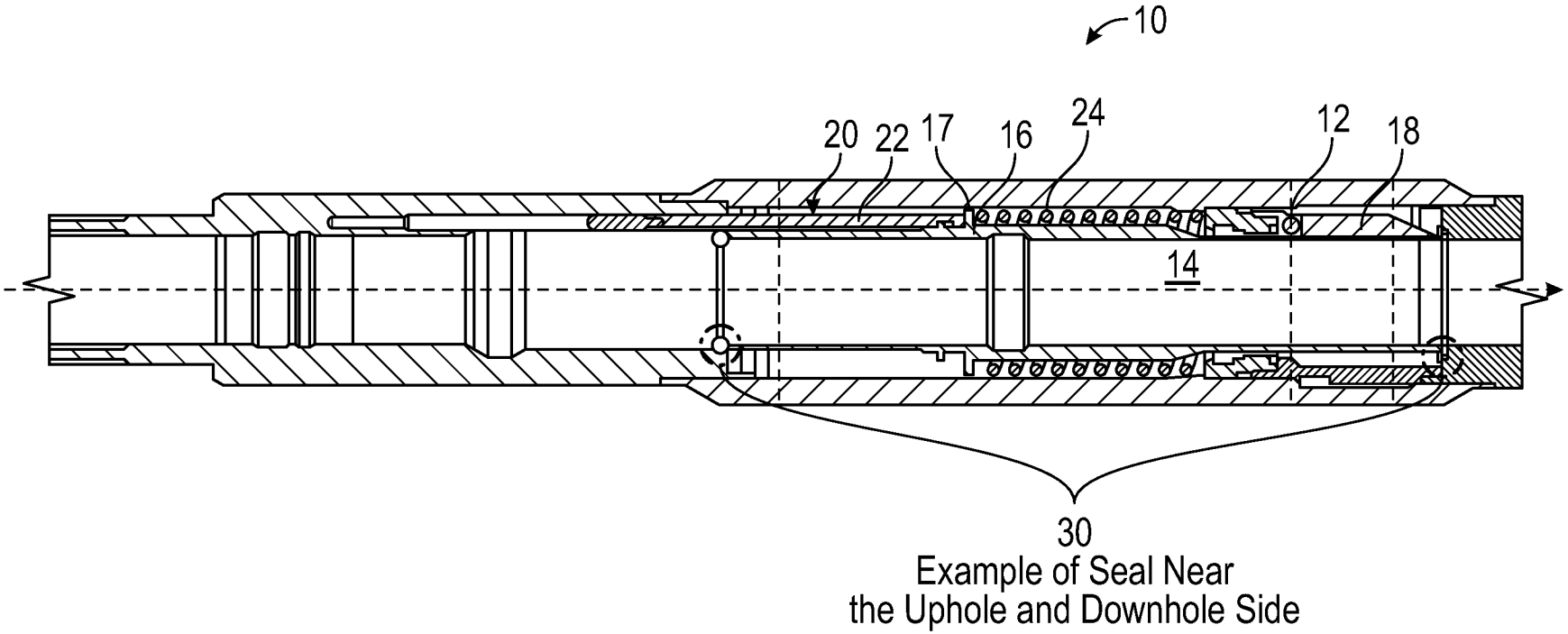

Referring now to FIGS. 3A-3C, in one or more embodiments of the present disclosure, the means for preventing fluid flowing through the bore 14 from entering the annular section 20 may include at least one seal 30 disposed proximate at least one of a downhole side of the flow tube 16, and an uphole side of the flow tube 16. For example, FIG. 3A shows at least one seal 30 disposed proximate a downhole side of the flow tube 16, FIG. 3B shows at least one seal 30 disposed proximate an uphole side of the flow tube 16, and FIG. 3C shows at least one seal 30 disposed proximate the uphole side and the downhole side of the flow tube 16, according to one or more embodiments of the present disclosure. Placement of the at least one seal 30 with respect to the flow tube 16, as shown in FIGS. 3A-3C, effectively seals off the annular section 20 of the safety valve 10 from the bore 14. Due to this placement of the at least one seal 30, fluid flowing through the bore 14 during proppant stimulation treatments or other injection operations is prevented from entering the annular section 20 of the safety valve 10. As previously mentioned, allowing debris to flow into critical areas such as the annular section 20 of the safety valve 10 may prevent the safety valve 10 from working properly. As such, the internal components of the safety valve 10 (i.e., the spring 24, the valve closure member 18, the valve actuator 22, etc.) may be protected from erosion and debris generated from such treatments and operations with the implementation of means for preventing fluid flowing through the bore 14 from entering the annular section 20 of the safety valve 10, such as the at least one seal 30 disposed proximate at least one of the downhole side of the flow tube 16, and the uphole side of the flow tube 16, as shown in FIGS. 3A-3C.

Moreover, the at least one seal 30 according to one or more embodiments of the present disclosure provides for an interventionless design insofar as a separate intervention is not required to install the at least one seal 30 once the safety valve 10 is installed downhole. Indeed, the safety valve 10 may be assembled with the at least one seal 30 already installed before the safety valve 10 is run downhole. The elimination of an additional trip to install the at least one seal 30 advantageously saves time and money over solutions that require an intervention, for example. In one or more embodiments of the present disclosure, the at least one seal 30 is made out of an elastomer or any other material that is able to prevent leakage into the annular section 20 during the operation life of the safety valve 10 (i.e., a fluid tight seal).

Figure 4:
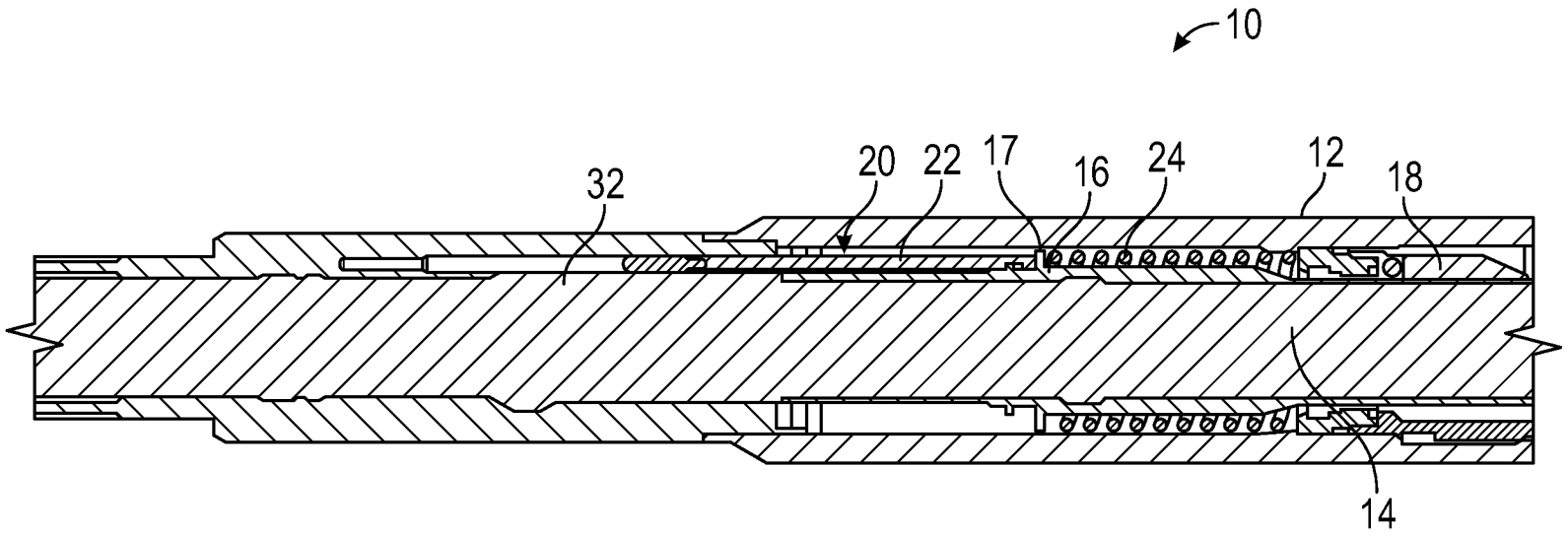
FIG. 4 shows a safety valve including a seamless and continuous diameter within a bore of the safety valve according to one or more embodiments of the present disclosure.

Referring now to FIG. 4, in one or more embodiments of the present disclosure, the means for preventing fluid flowing through the bore 14 from entering the annular section 20 may include a temporary barrier 32 that adheres to and protects an internal profile of the bore 14 by creating a seamless and continuous diameter within the bore 14. That is, a temporary barrier 32, such as an adhesive coating or finish, may be applied to any equipment having an internal profile to provide a continuous, flush, and seamless bore internal profile. Advantageously, the temporary barrier 32 according to one or more embodiments of the present disclosure may work with multiple profiles, steps, and various parts that provide many transitions through the internal profile. By using the temporary barrier 32 to create a seamless and continuous diameter within the bore 14, the internal profile of the bore 14 may be protected from debris and erosion during proppant stimulation treatments or other injection operations, for example. In one or more embodiments of the present disclosure, the temporary barrier 32 may also reduce the occurrence of undesirable pressure losses during these types of treatments or operations. As shown in FIG. 4, the temporary barrier 32 may also protect critical components of the safety valve 10 by preventing fluid flowing through the bore 14 during proppant stimulation treatments or other injection operations from entering the annular section 20 of the safety valve 10. Allowing debris to flow into critical areas such as the annular section 20 of the safety valve 10 may prevent the safety valve 10 from working properly. As such, the internal components of the safety valve 10 (i.e., the spring 24, the valve closure member 18, the valve actuator 22, etc.) may be protected from erosion and debris generated from such treatments and operations with the implementation of means for preventing fluid flowing through the bore 14 from entering the annular section 20 of the safety valve 10, such as the temporary barrier 32 shown in FIG. 4.

Advantageously, after the proppant stimulation treatment or other injection operation is complete, the temporary barrier 32 may be eliminated to uncover the internal profile of the bore 14 of the safety valve 10 or other equipment. In this way, the temporary barrier 32 may be made of a material that is dissolvable, heat degradable, or any other material that is capable of disappearing over time. For example, the temporary barrier 32 may include a metal that is degradable or dissolvable, for example.

Moreover, the temporary barrier 32 according to one or more embodiments of the present disclosure provides for an interventionless design insofar as a separate intervention is not required to apply the temporary barrier 32 once the safety valve 10 or other equipment is installed downhole. Indeed, in a method according to one or more embodiments of the present disclosure, the temporary barrier 32 is already applied to the safety valve 10 or other equipment or device before the safety valve 10 or other equipment or device is run downhole. The elimination of an additional trip to apply or install the temporary barrier 32 advantageously saves time and money over solutions that require a separate intervention or trip, for example.

While the aforementioned embodiments of the present disclosure are directed to a subsurface safety valve, one or more embodiments of the present disclosure may also be applicable to other types of flow control devices, valves, or devices without departing from the scope of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A safety valve, comprising:
- a housing having a bore;
- a flow tube residing in the bore and configured to move telescopically within the bore;
- an annular section between an inner surface of the housing and an outer surface of the flow tube;
- a valve closure member, wherein the flow tube is adapted to shift the valve closure member between a closed position and an open position; and
- a sacrificial material disposed in the bore and configured to prevent fluid flowing through the bore from entering the annular section.

2. The safety valve of claim 1, further comprising:
- a spring adapted to move the flow tube,
- wherein the spring, and the valve closure member when the valve closure member is in the open position, are disposed in the annular section.

3. The safety valve of claim 2, further comprising:
- a piston connected to the flow tube, the piston configured to actuate the flow tube,
- wherein at least a portion of the piston is disposed in the annular section when the valve closure member is in the open position.

4. The safety valve of claim 3, wherein the piston is hydraulically actuated.

5. The safety valve of claim 4,
- wherein, when the piston is forced in a downward direction by a control pressure, the piston actuates the flow tube in the downward direction, enabling the valve closure member to be in the open position, and
- wherein, when the piston is forced in an upward direction, the piston actuates the flow tube in the upward direction, enabling the valve closure member to be in the closed position.

6. The safety valve of claim 1, wherein the sacrificial material is disposed on the flow tube.

7. The safety valve of claim 1, wherein the sacrificial material comprises a metallic material.

8. A safety valve, comprising:
- a housing having a bore, wherein the bore comprises an internal profile;
- a flow tube residing in the bore and configured to move telescopically within the bore;
- an annular section between an inner surface of the housing and an outer surface of the flow tube;
- a valve closure member, wherein the flow tube is adapted to shift the valve closure member between a closed position and an open position; and
- a temporary barrier that adheres to and protects the internal profile by creating a seamless and continuous diameter within the bore, wherein the temporary barrier is configured to prevent fluid flowing through the bore from entering the annular section.

9. The safety valve of claim 8, wherein the temporary barrier is a coating.

10. The safety valve of claim 8, wherein the temporary barrier is degradable or dissolvable.

11. The safety valve of claim 10, wherein the temporary barrier comprises a metal that is degradable or dissolvable.

12. The safety valve of claim 8, wherein the temporary barrier is an adhesive coating.

13. The safety valve of claim 8, further comprising:

a spring adapted to move the flow tube, wherein the spring, and the valve closure member when the valve closure member is in the open position, are disposed in the annular section.

14. The safety valve of claim 13, further comprising:

a piston connected to the flow tube, the piston configured to actuate the flow tube, wherein at least a portion of the piston is disposed in the annular section when the valve closure member is in the open position.

15. The safety valve of claim 14, wherein the piston is hydraulically actuated.

16. The safety valve of claim 15, wherein, when the piston is forced in a downward direction by a control pressure, the piston actuates the flow tube in the downward direction, enabling the valve closure member to be in the open position, and wherein, when the piston is forced in an upward direction, the piston actuates the flow tube in the upward direction, enabling the valve closure member to be in the closed position.

* * * * *